US007455035B2

(12) United States Patent
Sanai

(10) Patent No.: US 7,455,035 B2
(45) Date of Patent: Nov. 25, 2008

(54) COOLING WATER PIPING ATTACHMENT STRUCTURE FOR SMALL BOAT

(75) Inventor: Daisuke Sanai, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 34 days.

(21) Appl. No.: 11/519,478

(22) Filed: Sep. 11, 2006

(65) Prior Publication Data

US 2007/0066159 A1 Mar. 22, 2007

(30) Foreign Application Priority Data

Sep. 9, 2005 (JP) ..... 2005-261518

(51) Int. Cl.
*F01P 7/00* (2006.01)
*F01P 3/20* (2006.01)

(52) U.S. Cl. ..... 123/41.02; 440/88 C

(58) Field of Classification Search ..... 123/195 R, 123/41.08, 41.02; 440/88 C
See application file for complete search history.

(56) References Cited

U.S. PATENT DOCUMENTS 6,408,802 B1 6/2002 Funahashi
2002/0115360 A1* 8/2002 Mashiko ..... 440/88
2004/0050039 A1* 3/2004 Matsuda ..... 60/323
2004/0200444 A1 10/2004 Sugano et al.
2006/0065230 A1 3/2006 Hoi

FOREIGN PATENT DOCUMENTS

JP 2002-161803 6/2002
JP 2002-242673 8/2002

* cited by examiner

*Primary Examiner*—Noah Kamen
(74) *Attorney, Agent, or Firm*—Knobbe, Martens, Olson & Bear, LLP

(57) ABSTRACT

A cooling water attachment device for a small boat can include a joint attachment part having a cooling water inlet/outlet port provided on a side surface of an engine opposite an exhaust pipe. A joint member can be formed with a recess for communication with the cooling water inlet/outlet port and can be attached to the joint attachment part. Branch piping and connection piping can be connected to the joint member. The branch piping and the connection piping can extend parallel to the side surface of the engine. The joint member can be attached below the lowest end of a water cooling jacket part, and the branch piping can extend downward from the joint member.

20 Claims, 7 Drawing Sheets

COOLING WATER PIPING ATTACHMENT STRUCTURE FOR SMALL BOAT

PRIORITY INFORMATION

The present application is based on and claims priority under 35 U.S.C. § 119 to Japanese Patent Application No. 2005-261518, filed on Sep. 9, 2005, the entire contents of which are expressly incorporated by reference herein.

BACKGROUND OF THE INVENTIONS

1. Field of the Inventions

The present inventions relate to cooling systems for small boats, including water pipe attachment structures for small boats in which cooling water from outside the boat is used to cool the engine.

2. Description of the Related Art

Certain typical water-cooled marine engines include a water jacket that is configured to cool the engine, including the cylinder block and cylinder head. The cooling systems of some of these marine engines are known as "open-loop" cooling systems, which use water from the body of water in which the associated boat is operating for cooling the engine.

For example, Japanese Patent Document JP-A-2002-242673 discloses such a boat. In such small boats, cooling water is supplied to the engine via cooling water piping or "plumbing". An example of attachment structure of the cooling water piping is shown in FIG. 10.

As shown in FIG. 10, a cooling water attachment structure 40 is provided in the vicinity of a water cooling jacket part 43 formed in a cylinder body 42 of an engine 41. The structure 40 includes three pieces of cooling water piping 44*a*, 44*b* and 44*c*, a cooling water piping attachment part 45 attached to the main body of the engine 41, and a pressure regulating valve 46 installed in the cooling water piping attachment part 45. A cooling water inlet/outlet port 47 is formed between the water cooling jacket part 43 and the cooling water piping attachment part 45. A cooling water passage 48 for communicating the cooling water piping 44*a*, 44*b* and 44*c* with the cooling water inlet/outlet port 47 is formed in the cooling water piping attachment part 45.

Cylindrical connection parts 49*a*, 49*b* and 49*c* for respectively fixing the cooling water piping 44*a*, 44*b* and 44*c* are formed on a surface of the cooling water piping attachment part 45. The cooling water piping 44*a*, 44*b* and 44*c*, respectively, surround the outer periphery of the connection parts 49*a*, 49*b* and 49*c*.

When the engine 41 is in operation, cooling water is supplied primarily from the cooling water piping 44*a* via the cooling water passage 48 and the cooling water inlet/outlet port 47 into the water cooling jacket part 43 to cool the engine 41. Some of the cooling water is supplied into the water cooling jacket part 43 from the cooling water piping 44*b*.

When the engine 41 is stopped, the cooling water in the water cooling jacket part 43 is discharged out of the boat through the cooling water inlet/outlet port 47, the cooling water passage 48 and the cooling water piping 44*b*. When the pressure in the water cooling jacket part 43 is increased, the pressure regulating valve 46 is actuated to discharge the cooling water in the water cooling jacket part 43 to the outside through the cooling water piping 44*c*.

SUMMARY OF THE INVENTIONS

An aspect of at least one of the embodiments disclosed herein includes the realization that in conventional cooling water attachment devices 40 (FIG. 10) described above, the cooling water piping 44*a*, 44*b* and 44*c* is concentrated at the cooling water attachment part 45 which can present unnecessary obstructions during maintenance of the engine 41 around the cooling water piping attachment part 45.

Thus, in accordance with an embodiment, a cooling water attachment device can be provided for a small boat that draws cooling water from outside the boat via cooling water piping to a water cooling jacket part formed in an engine of the boat to cool the engine. In some embodiments, the cooling water attachment device can comprise a cooling water inlet/outlet port formed on a side surface of the engine juxtaposed to an exhaust pipe or an intake pipe. Additionally, the cooling water attachment device can comprise a joint member including a cooling water passage fluidically connecting plural cooling water pipes with the cooling water inlet/outlet port.

In accordance with another embodiment, a marine engine can comprise an engine body, the engine body defining at least one combustion chamber, and a cooling jacket in thermal communication with the engine body and configured to allow water to be pumped therethrough so as to cool at least a portion the engine body. At least one port can be configured to allow a gaseous fluid to pass between an exterior of the engine body and an interior of the combustion chamber. At least one pipe can be configured to guide at least a gaseous fluid between an exterior of the engine and the at least one port. The at least one pipe can extend from the port and outwardly away from the engine body, thereby defining a space between an outer surface of the engine body and a surface of the pipe facing toward the outer surface of the engine body. The engine body can include a cooling water port on the outer surface of the engine body facing the space. The marine engine can further comprise a connector device disposed at least partially in the space and connecting the cooling water port with at least a first cooling water conduit.

In accordance with a further embodiment, a marine engine can comprise an engine body, the engine body defining at least one combustion chamber, and a cooling jacket in thermal communication with the engine body and configured to allow water to be pumped therethrough so as to cool at least a portion the engine body. At least one port can be configured to allow a gaseous fluid to pass between an exterior of the engine body and an interior of the combustion chamber. At least one pipe can be configured to guide at least a gaseous fluid between an exterior of the engine and the at least one port. The at least one pipe can extend from the port and outwardly away from the engine body, thereby defining a space between an outer surface of the engine body and a surface of the pipe facing toward the outer surface of the engine body. The engine body can include a cooling water port on the outer surface of the engine body facing the space. The marine engine can further comprise means for connecting the cooling water port with at least a first cooling water conduit, wherein at least one of the means for connecting and the first cooling conduit is disposed at least partially in the space.

BRIEF DESCRIPTION OF THE DRAWINGS

These and other features, aspects and advantages will now be described with reference to drawings of preferred embodiments. The drawings comprise the following figures.

DETAILED DESCRIPTION OF THE PREFERRED EMBODIMENTS

Figure 1:
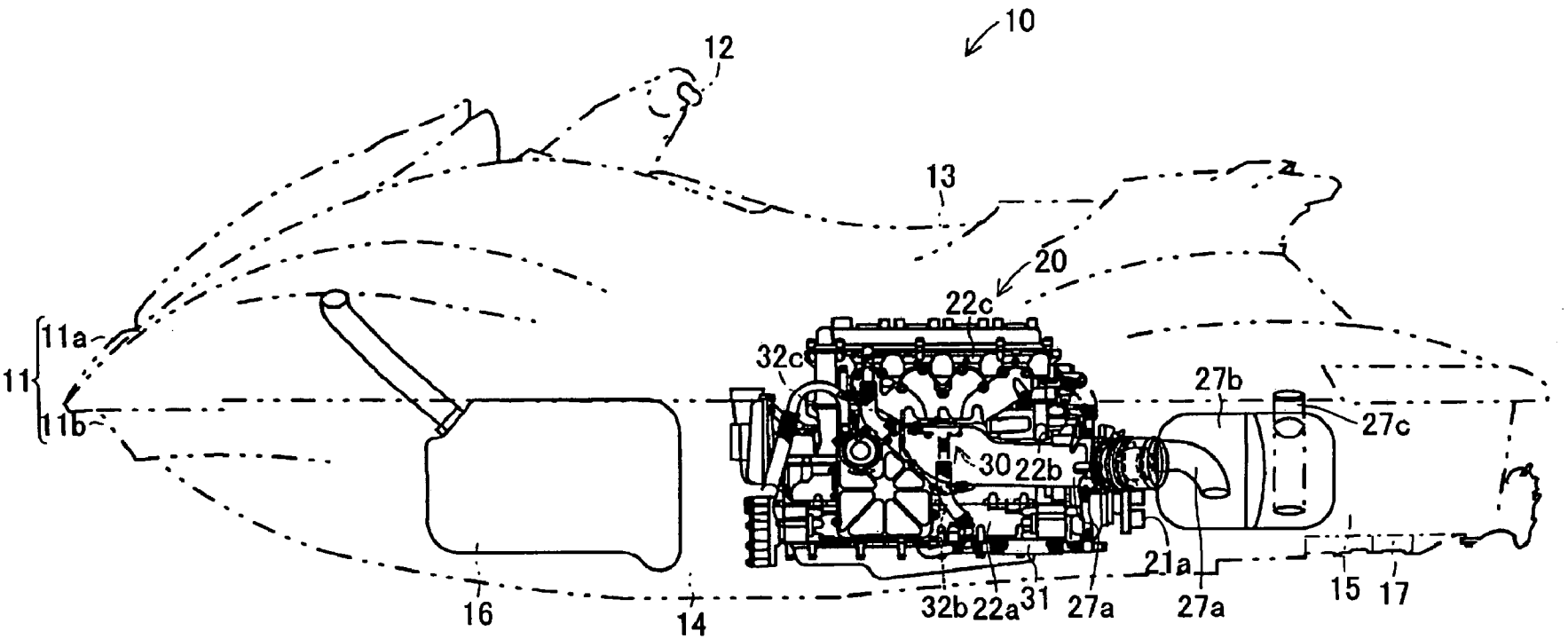
FIG. 1 is a side elevational and partial sectional view of a planning-type boat having a cooling system according to an embodiment.

FIG. 1 shows a planning-type boat 10 provided with a cooling system according an embodiment. In some embodiments, the cooling system includes a cooling water attachment device 30. The cooling system is disclosed in the context of a planning-type boat because it has particular utility in this context. However, the cooling system can be used in other contexts, such as, for example, but without limitation, outboard motors, inboard/outboard motors, and for engines of other vehicles including non-planing type boats, air, and land vehicles.

With continued reference to FIG. 1 the small boat 10 can have a body 11 including a deck 11*a* and a hull 11*b* connected together. Steering handlebars 12 can be provided at the upper part of the body 11 generally in the middle. A seat 13 is provided in the rear of the handlebars 12. The handlebars 12 and/or the seat 13 can define the operator's area of the body 11.

The inside of the body 11 can be divided into an engine compartment 14 and a pump compartment 15. However, the inside of the body 11 can also be divided into other numbers of compartments, or it can be a single compartment. Additionally, in some embodiments, the compartments 14, 15, and/or any other compartment in the body 11, can be defined by bulkheads, not shown.

The engine compartment 14 can include a fuel tank 16, an engine 20, etc. The pump compartment 15, on the other hand, can include a propulsion unit 17 including a jet pump, etc.

Air ducts (not shown) can be provided in the front and rear parts of the engine compartment 14 and can be configured to introduce or circulate outside air into or through the engine compartment 14. The air ducts can extend generally vertically from the upper part of the body 11 to the bottom of the engine compartment 14. Additionally, the air ducts can be constructed to draw outside air from the upper ends through waterproof devices (not shown) provided in the deck 11*a* and to introduce the air into the engine compartment 14 from the lower ends.

The fuel tank 16 can be disposed at the front bottom of the engine compartment 14, and the engine 20 can be disposed in the rear part of the engine compartment 14 (at the center bottom of the body 11).

Figure 2:
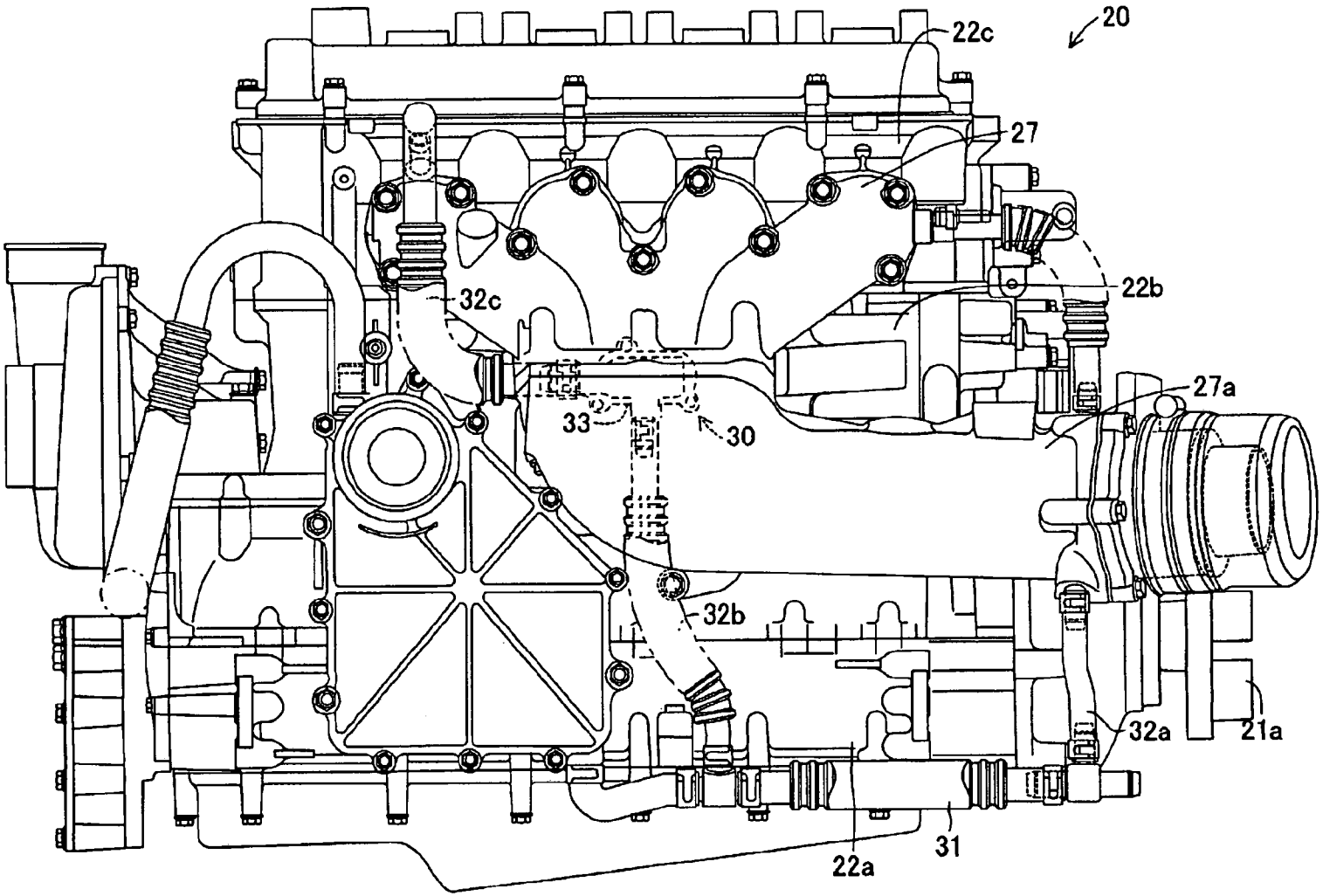
FIG. 2 is an enlarged starboard side elevational view of the engine of the boat of FIG. 1, and showing cooling water attachment device in phantom line.
Figure 3:
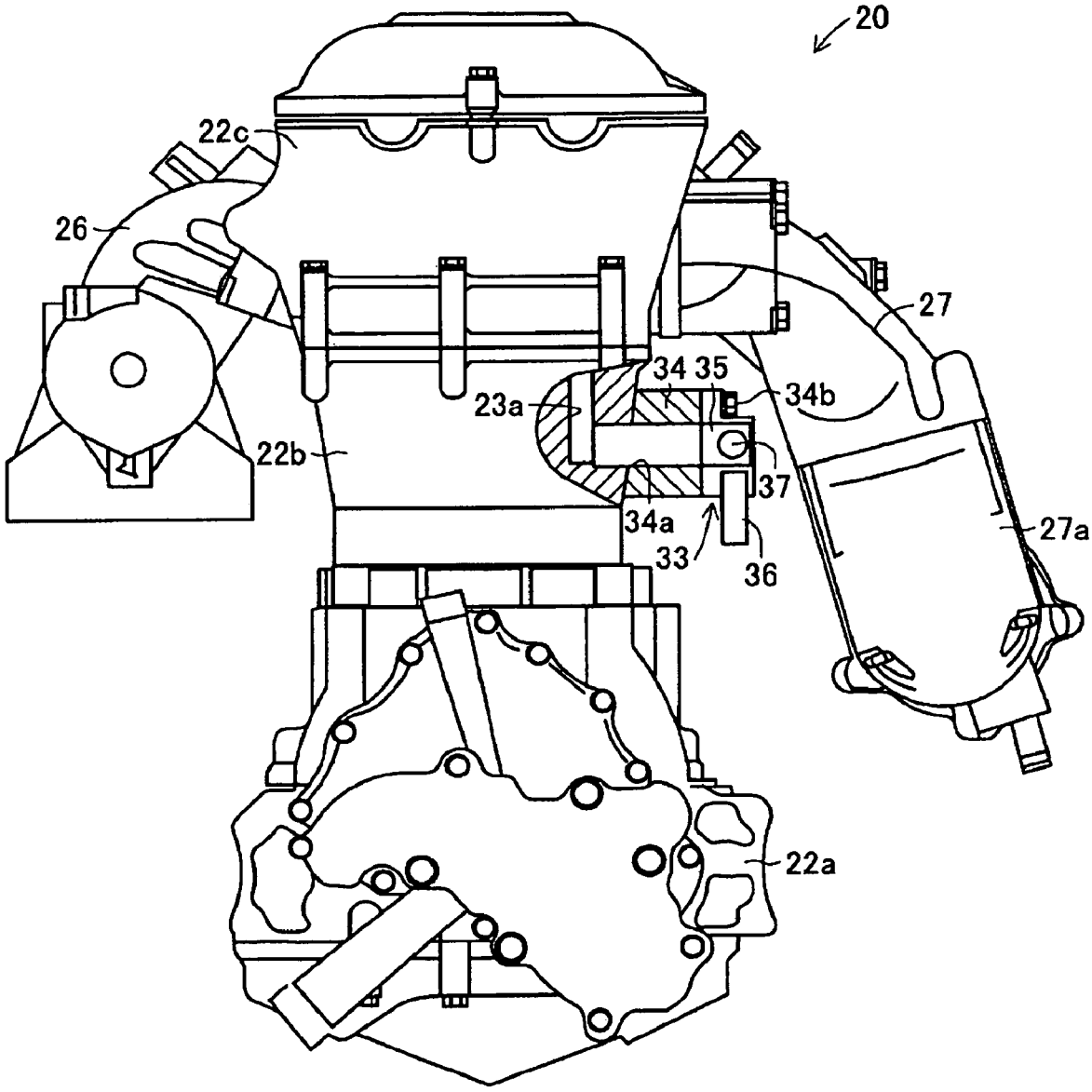
FIG. 3 is a front elevational and partial sectional view of the engine showing the cooling water attachment device in section.
Figure 4:
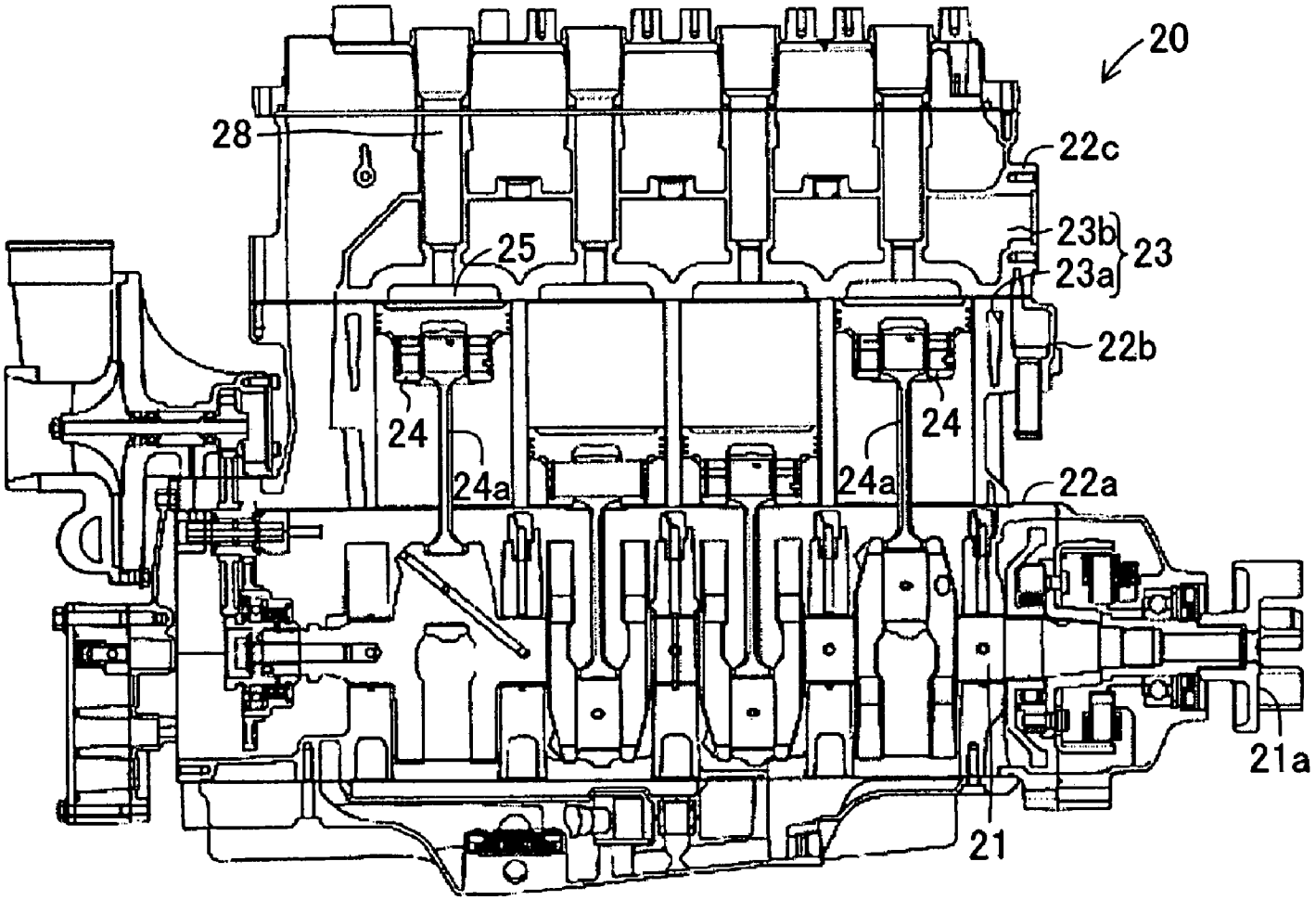
FIG. 4 is a port side sectional view of the engine.

The engine 20 can be a water-cooled in-line 4-cycle 4-cylinder engine constructed as shown in FIGS. 2 to 4. However, other engines, operating on other combustion principles (e.g., 2-stoke, diesel, rotary, etc.), having other numbers of cylinders, and having other cylinder configurations can also be used.

With reference to FIG. 4, the outer shell of the engine 20 can have a cylinder body 22*b* and a cylinder head 22*c* sequentially assembled to the upper part of a crankcase 22*a* for housing a crankshaft 21. A water cooling jacket part 23 for cooling the cylinder body 22*b* and the cylinder head 22*c* can be formed inside the cylinder body 22*b* and the cylinder head 22*c*.

The water cooling jacket part 23 can be formed with a lower jacket 23*a* formed in the cylinder body 22*b*, and an upper jacket 23*b* formed in the cylinder head 22*c* and in communication with the lower jacket 23*a*.

Pistons 24, which are coupled to the crankshaft 21 via respective connecting rods 24*a*, are housed inside the cylinder body 22*b* and the cylinder head 22*c* so as to be vertically movable. The vertical movements of the pistons 24 are transmitted to the crankshaft 21 providing rotational movement of the crankshaft 21. Cylinders 25 formed in the cylinder head 22 and each have an intake valve and an exhaust valve (not shown).

With reference to FIG. 3, intake ports can be in communication with the intake valve of each cylinder 25 and can be connected to an intake system 26 having at least one intake pipe 26. Similarly, exhaust ports can be in communication with the exhaust valve of each cylinder 25 and can be connected to an exhaust system having at least one exhaust pipe 27.

With reference to FIG. 4, during operation, the intake valves open during the intake stroke of their respective pistons 24 so as to allow a mixture of air from the intake system and fuel supplied from a fuel supply system (not shown) into the cylinder head 22*c*. Thereafter, the intake valves are closed for at least most of the subsequent power and exhaust strokes.

The exhaust valves, on the other hand, open during the exhaust stroke to allow combustion gases to be discharged from the cylinder head 22 via the exhaust port to the exhaust system. Hereafter, the exhaust valves close during at least most of the subsequent intake stroke.

A fuel supply system for supplying fuel from the fuel tank 16 to the engine 20 can include a fuel pump, a fuel injector (not shown), and/or other components. The fuel pumped out of the fuel tank 16 by the operation of the fuel pump can be atomized and injected into the cylinders 25 by the fuel injector. At that time, the fuel can be mixed with the air from the intake system, and the resulting air-fuel mixture can be fed into the cylinders 25.

The engine 20 can be provided with an ignition plug (not shown) mounted in an ignition plug mounting hole 28. The ignition plug can be configured to ignite the air-fuel mixture so that the mixture explodes. The explosion causes the piston 24 to downwardly within its cylinder, i.e., away from the cylinder head 22, which in turn rotates the crankshaft 21.

With reference again to FIGS. 2 and 3, the exhaust pipe 27 can extend obliquely downwardly from its upstream end connected to the exhaust port of the cylinder 25 to its downstream end connected to a muffler 27*a*. The muffler 27*a* can be disposed longitudinally so as to extend along generally the middle of the portside surface of the engine 20, and can be constructed of a double pipe made of aluminum. The space between the two walls of the double pipe can be utilized as a cooling water passage for allowing the cooling water to flow and thereby cool the muffler 27. However, other configurations can also be used.

With reference to FIG. 1, the downstream end of the muffler 27*a* can be connected to a water lock 27*b*. The water lock 27*b* can be constructed with a cylindrical tank having a large diameter. An exhaust gas pipe 27*c* can extend rearwardly from a rear top surface of the cylindrical tank.

After extending upwardly for a short distance, the exhaust gas pipe 27*c* can pass through a casing (not shown) for isolating the propulsion unit 17 from the main part of the body 11, and can then be merged with a water jet nozzle of the propulsion unit 17.

An impeller shaft (not shown) can be coupled to the crankshaft 21 via a coupling 21*a* and can extend rearwardly from the rear of the engine 20 into the pump compartment 15. The impeller shaft can be coupled to an impeller provided in the propulsion unit 17 disposed at the stern of the body 11, and can thereby transmit the rotational force of the crankshaft 21 driven by the engine 20 to the impeller to rotate. The impeller shaft can comprise a single shaft extending from the coupling 21*a* to the impeller, or can be made of two or more shafts connected to together with rotational couplings. However, other configurations can also be used.

With reference to FIG. 2, the small boat 10 can have a plurality of pieces of cooling water piping for cooling the aforementioned devices, especially the engine 20. Of these pieces of cooling water piping, the one provided in the vicinity of the muffler 27*a* can be provided with a cooling water attachment device 30. However, the cooling water attachment device 30 or other similar devices can also be disposed in other places in the boat 10, and additional cooling water attachment devices 30 can also be used in other places of the cooling system or other systems.

With reference to FIG. 2, in some embodiments, cooling water piping 31 connected to the jet pump of the propulsion unit 17 is provided on a side of the engine 20 and below the muffler 27*a*. Branch piping 32*a* and 32*b*, which can be rubber hose or other materials, extend upwardly from rear and central areas of the engine 20, respectively.

The branch piping 32*a* can pass through the cooling water path in the muffler 27*a* and can also be in communication with the upper jacket 23*b* formed in the cylinder head 22*c*. Thus, in some embodiments, cooling water flowing through the branch piping 32*a* can be sent to the upper jacket 23*b* while heated by high-temperature combustion gas flowing through the muffler 27*a* to the downstream side. This prevents the cylinder head 22*c* from being suddenly cooled by low-temperature cooling water.

The branch piping 32*b* can pass behind the muffler 27*a* (along a side surface of the engine 20) and can extend to below the exhaust pipe 27, with its upper end connected to a joint member 33. A joint attachment part 34 having a cooling water inlet/outlet port 34*a* can communicate with the lower end of the lower jacket 23*a* and can be provided on the side surface of the engine 26. In some embodiments, this lower end of the lower jacket 23*a* can be the lowermost part of the lower jacket 23*a*.

With reference to FIG. 3, the joint member 33 can be fixed to the joint attachment part 34 via bolts 34*b*. The joint member 33 can include a main part 35 and two connection pipes 36 and 37. However, other configurations can also be used. The connection pipes 36 and 37 can be considered as providing branch cooling water passages, also shown in FIGS. 5 to 9. However, other components and/or configurations can also provide branch cooling water passages.

Figure 5:
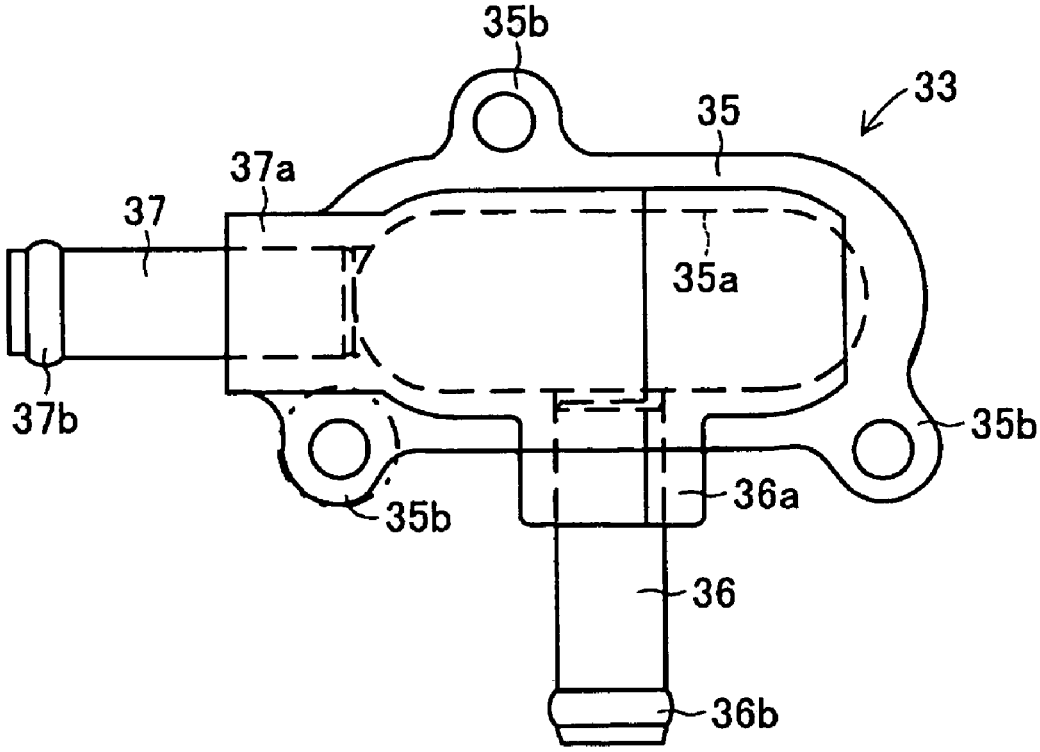
FIG. 5 is a front side elevational view of a joint member that can be used with the cooling water attachment device.

FIG. 5 can be considered a front side elevational view of the joint member 33, and this designation is used throughout the description o the joint member 33 herein. However, the designation of any side of the joint member 33 as being the "front" can be arbitrary. Further, when the joint member 33 is connected to the boat 10 in the orientation illustrated in FIGS. 2 and 3, the view of FIG. 5 would correspond to a starboard side elevational view of the boat 10. However, as noted above, the point of view of FIG. 5 is arbitrarily designated as a "front" elevational view, and the description of the joint member 33 set forth below relies on this designation for purposes of identifying the "right", "left", "top", "bottom", and "back" sides of the joint member 33 and its components.

With reference to FIGS. 5-9, the main part 35 can include a generally oval member with a recess 35*a* formed on its back surface. The recess 35*a* can be considered as forming a primary cooling water passage. However, other components or configurations can also be used to form a primary cooling water passage.

Three bolt hole parts 35*b* can be formed with a bolt hole for insertion of the bolts 34*b* are and can be provided on the outer periphery of the main part 35 at predetermined intervals.

Figure 8:
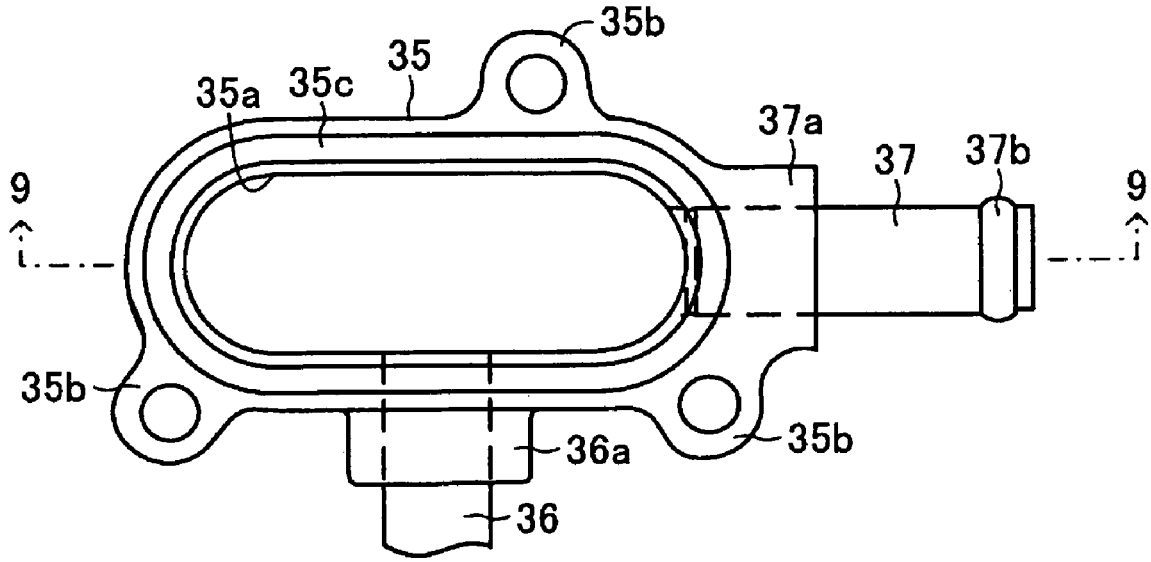
FIG. 8 is a rear elevational view of the joint member.

With reference to FIG. 8, an annular groove 35*c* can be provided along the outer peripheral edge of the back surface of the main part 35. The annular groove 35*c* can be formed for attachment of a ring-shaped seal member (not shown) when the joint member 33 is fixed to the joint attachment part 34.

Connection pipe attachment parts 36*a* and 37*a* can be configured to provide fluidic communication between the inside and the outside of the main part 35. However, other components or configurations can also be used to provide fluidic communication.

The pipe attachment parts 36*a* and 37*a* can be formed at the lower center and on the left side, respectively, of the main part 35. However, other positions can also be sued.

The connection pipes 36 and 37 can be attached to the main part 35 via the connection pipe attachment parts 36*a* and 37*a*, respectively. The connection pipes 36 and 37 and the recess 35*a* can be formed such that the directions of cooling water flows therethrough are perpendicular to each other. However, other orientations can also be used.

Figure 6:
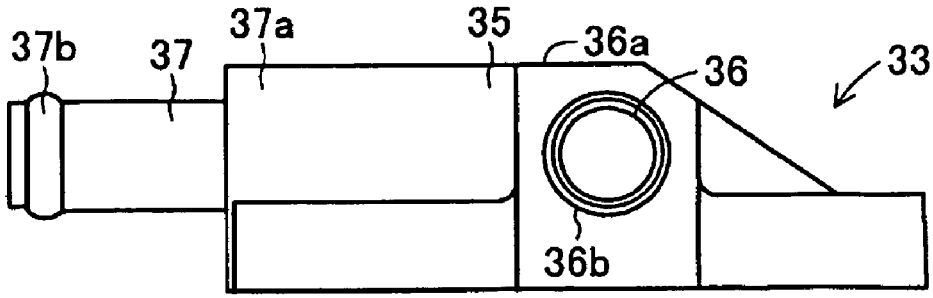
FIG. 6 is a bottom plan view of the joint member of FIG. 5.
Figure 7:
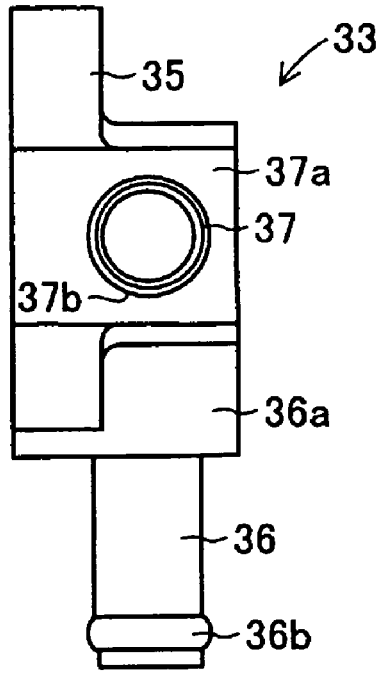
FIG. 7 is a left side elevational view of the joint member.
Figure 9:
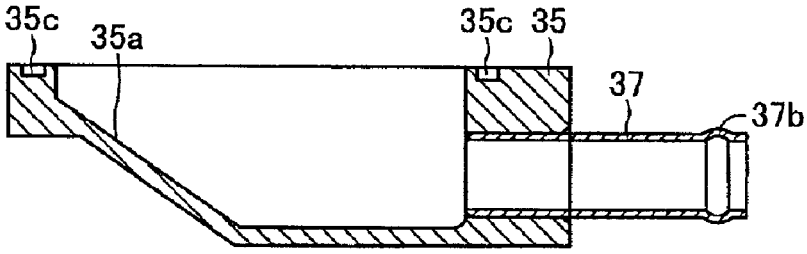
FIG. 9 is a sectional view of the joint member taken along the line 9-9 of FIG. 8.
Figure 10:
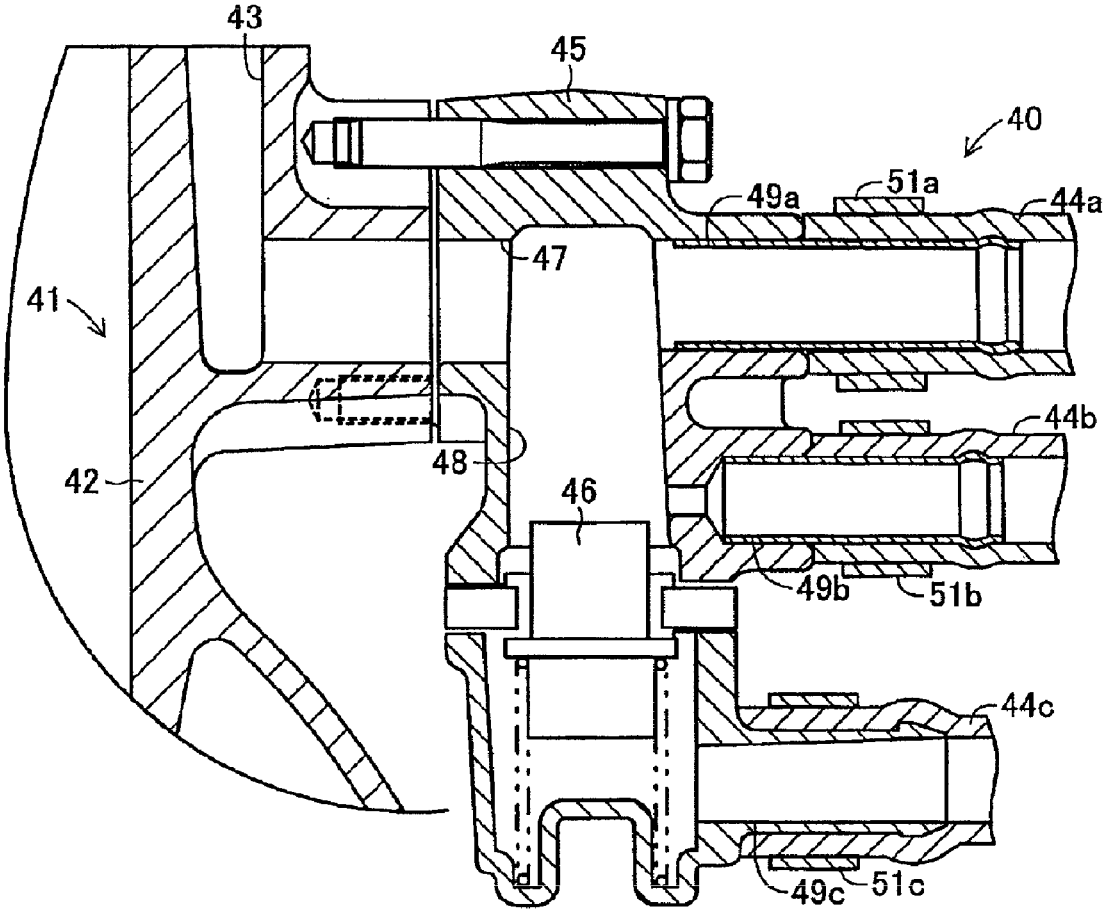
PRIOR ART Figure 10
FIG. 10 is a sectional view of a conventional cooling water attachment device.

Projections 36*b* and 37*b* for engagement can be formed around the periphery of the distal ends of the connection pipes 36 and 37, respectively. As illustrated in FIGS. 6 and 9, the left side of the front surface of the main part 35 can be formed to be parallel to its back surface, and the right side of the front surface of the main part 35 can be formed to be gradually inclined toward its back surface from its center to its right end.

The connection pipe 36 can be connected to the upper end of the branch piping 32*b*. The connection pipe 37 can be connected to connection piping 32*c*, of which the upper end is in communication with the water cooling jacket part (not shown) provided in the upper part of the engine 20. The connection piping 32*c* can also extend along the side surface of the engine 20.

Thus, when the engine 20 is driven, cooling water is sent from the jet pump of the propulsion unit 17 to the cooling water piping 31 and enters the water cooling jacket part 23 of the engine 20, and flows through the branch piping 32*a* and 32*b* and the connection piping 32*c*, for cooling purposes. When the engine 20 is stopped, the cooling water flows out of the boat from the branch piping 32*b* and other pipes the joint member 33 which is in communication with the lowest end of the water cooling jacket part 23. In addition to the aforementioned devices, the small boat 10 in some embodiments, can include an electronic control unit and various electric equipment, including a CPU, a ROM, a RAM a timer, as well as other various devices that can be used to run the small boat 10, such as a power switch, a start switch and various sensors.

During operation, the small boat 10 constructed as described above, a power switch can be turned on, and then a start switch can be turned on. This makes the small boat 10 ready to run. As an operator operates the steering handlebars 12 and a throttle controller (not shown) provided on a grip of the steering handlebars 12, the small boat 10 runs in a specified direction at a specified speed in accordance with the operations.

Outside air can be drawn into the engine compartment 14 via the air ducts. The air can be fed to the engine 20 via the intake system and mixed with fuel fed from the fuel tank 16. The air-fuel mixture explodes within the cylinder 25 as it is ignited by the ignition plug to drive the engine 20. The rotational force of the crankshaft 21 driven by the engine 20 is transmitted to the impeller shaft to drive the propulsion unit 17. The combustion gas generated within the cylinders 25 as a result of the explosion of the mixture is sent to the water jet nozzle of the propulsion unit 17 via the exhaust system, and is discharged out of the boat through the water jet nozzle.

During such operation, the devices such as the engine 20 are cooled by cooling water supplied to the cooling water passages such as the cooling water piping 31, and thus those devices are prevented from being heated excessively. Thus, each device is maintained in proper condition during operation.

Seawater can be used as the cooling water, which is sucked into the boat by the jet pump provided at the stern of the body 11. When the engine 20 is stopped, the cooling water is discharged out of the boat through piping for drainage such as the branch piping 32*b*. This prevents corrosion due to the cooling water remaining in the engine 20 or the like.

As described above, in the cooling water attachment device 30 for the small boat 10 according to some embodiments, the joint member 33 can be installed between the side surface of the engine 20 and the exhaust pipe 27 and hence hidden by the exhaust pipe 27 and the muffler 27*a*. Thus, the branch piping 32*b* and the connection piping 32*c* do not present obstructions to those performing maintenance or repairs on the engine 20. The branch piping 32*b* and the connection piping 32*c* can be connected to one part but can be arranged to extend in different directions, thus further reducing obstructions to maintenance procedures. The joint member 33, at or in the vicinity of which can be a concentration of cooling water connectors and/or pipes, can thus be installed in a dead space between the side surface of the engine 20 and the exhaust pipe 27, allowing effective use of the dead space and thereby making better use of the limited space within the engine compartment 14.

Since, in some embodiments, the connection pipes 36 and 37 of the joint member 33 do not project horizontally from the side surface of the engine 20 but extend along the side surface of the engine 20, the branch piping 32*b* and the connection piping 32*c* connected to the connection pipes 36 and 37 also do not project from but extend along the side surface of the engine 20. Thus, the joint member 33, the branch piping 32*b* and the connection piping 32*c* are easily installed in a narrow space between the side surface of the engine 20 and the exhaust pipe 27. Additionally because these components are generally continuously cooled by cooling water, performance of the boat 10 is not adversely affected by the placement of these components in a space that is bordered by or, in some embodiments, surrounded by hot surfaces.

In addition, since the branch piping 32*b* and the connection piping 32*c*, which can be inexpensively made from rubber or other materials, do not contact the exhaust pipe 27 or the muffler 27*a*, which are at high temperatures, the branch piping 32*b* and the connection piping 32*c* will not be damaged by the heat.

Additionally, since the joint member 33 can be attached to a position corresponding to the cooling water inlet/outlet port 34*a* in communication with the lowest end of the water cooling jacket part 23, and the branch piping 32*b* can extend downwardly from the lower end of the joint member 33 along the side surface of the engine 20, the cooling water in the water cooling jacket part 23 can be securely discharged. As a result, the cooling water will not remain in the engine 20 after engine stop, Which can prevent corrosion.

The cooling water attachment device 30 according to foregoing embodiments can be practiced with appropriate modifications. For example, the joint member 33, the branch piping 32*b* and the connection piping 32*c* can be installed between a side surface of the engine 20 and the intake pipe 26, different from the foregoing embodiment in which they are installed between a side surface of the engine 20 and the exhaust pipe 27. Additionally, in contrast to the foregoing embodiments in which two pieces of cooling water piping, namely the branch piping 32*b* and the connection piping 32*c*, are connected to the joint member 33, a larger number of pieces of cooling water piping can be connected to the joint member 33. Also in such cases, all the cooling water piping can be arranged to extend along the side surface of the engine 20. The rest of the parts and the like constituting the cooling water piping attachment structure 30 and the small boat 10 can be modified as appropriate within the technical scope of the present inventions.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A cooling water attachment device for a small boat that draws cooling water from outside the boat via cooling water piping to a water cooling jacket part formed in an engine of the boat to cool the engine, the cooling water attachment device comprising a cooling water inlet/outlet port formed on a side surface of the engine juxtaposed to an exhaust pipe or an intake pipe, and a joint member disposed between the side surface and the exhaust pipe or the intake pipe and including a cooling water passage fluidically connecting plural cooling water pipes with the cooling water inlet/outlet port.

2. The cooling water attachment device for a small boat according to claim 1, wherein the joint member is attached at the same height as or below a lowest end of the water cooling jacket part.

3. The cooling water attachment device for a small boat according to claim 1, in combination with a marine engine.

4. The cooling water attachment device for a small boat according to claim 3, in combination with a boat.

5. A cooling water attachment device for a small boat that draws cooling water from outside the boat via cooling water piping to a water cooling jacket part formed in an engine of the boat to cool the engine, the cooling water attachment device comprising a cooling water inlet/outlet port formed on a side surface of the engine juxtaposed to an exhaust pipe or an intake pipe, and a joint member including a cooling water passage fluidically connecting plural cooling water pipes with the cooling water inlet/outlet port, wherein the cooling water passage is formed with a primary cooling water passage in fluidic communication with the water cooling jacket of the engine via the cooling water inlet/outlet port, and plural branch cooling water passages extending generally perpendicular to the primary cooling water passage and along the side surface of the engine, wherein the plural cooling water pipes are respectively connected to the plural branch cooling water passages.

6. The cooling water attachment device for a small boat according to claim 5, wherein at least one of the plural branch cooling water passages extends downwardly along the side surface of the engine, and wherein at least one of the plural cooling water pipes is connected to a distal end of the downwardly extending branch cooling water passage, the downwardly extending branch cooling water passage being configured to allow cooling water to drain from the engine.

7. The cooling water attachment device for a small boat according to claim 6, wherein the joint member is attached at the same height as or below a lowest end of the water cooling jacket part.

8. The cooling water attachment device for a small boat according to claim 5, wherein the joint member is attached at the same height as or below a lowest end of the water cooling jacket part.

9. A marine engine comprising an engine body, the engine body defining at least one combustion chamber, a cooling jacket in thermal communication with the engine body and configured to allow water to be pumped therethrough so as to cool at least a portion the engine body, at least one port configured to allow a gaseous fluid to pass between an exterior of the engine body and an interior of the combustion chamber, at least one pipe configured to guide at least a gaseous fluid between an exterior of the engine and the at least one port, the at least one pipe extending from the port and outwardly away from the engine body, thereby defining a space between an outer surface of the engine body and a surface of the pipe facing toward the outer surface of the engine body, the engine body including a cooling water port on the outer surface of the engine body facing the space, the marine engine further comprising a connector device disposed at least partially in the space and connecting the cooling water port with at least a first cooling water conduit.

10. The marine engine according to claim 9, wherein the at least one pipe is an exhaust pipe.

11. The marine engine according to claim 9, in combination with a boat.

12. A marine engine comprising an engine body, the engine body defining at least one combustion chamber, a cooling jacket in thermal communication with the engine body and configured to allow water to be pumped therethrough so as to cool at least a portion the engine body, at least one port configured to allow a gaseous fluid to pass between an exterior of the engine body and an interior of the combustion chamber, at least one pipe configured to guide at least a gaseous fluid between an exterior of the engine and the at least one port, the at least one pipe extending from the port and outwardly away from the engine body, thereby defining a space between an outer surface of the engine body and a surface of the pipe facing toward the outer surface of the engine body, the engine body including a cooling water port on the outer surface of the engine body facing the space, the marine engine further comprising a connector device disposed at least partially in the space and connecting the cooling water port with at least a first cooling water conduit, wherein the at least one pipe is an intake air pipe.

13. A marine engine comprising an engine body, the engine body defining at least one combustion chamber, a cooling jacket in thermal communication with the engine body and configured to allow water to be pumped therethrough so as to cool at least a portion the engine body, at least one port configured to allow a gaseous fluid to pass between an exterior of the engine body and an interior of the combustion chamber, at least one pipe configured to guide at least a gaseous fluid between an exterior of the engine and the at least one port, the at least one pipe extending from the port and outwardly away from the engine body, thereby defining a space between an outer surface of the engine body and a surface of the pipe facing toward the outer surface of the engine body, the engine body including a cooling water port on the outer surface of the engine body facing the space, the marine engine further comprising a connector device disposed at least partially in the space and connecting the cooling water port with at least a first cooling water conduit, wherein the connector device comprises at least a first connector extending generally perpendicular to the cooling water port.

14. A marine engine comprising an engine body, the engine body defining at least one combustion chamber, a cooling jacket in thermal communication with the engine body and configured to allow water to be pumped therethrough so as to cool at least a portion the engine body, at least one port configured to allow a gaseous fluid to pass between an exterior of the engine body and an interior of the combustion chamber, at least one pipe configured to guide at least a gaseous fluid between an exterior of the engine and the at least one port, the at least one pipe extending from the port and outwardly away from the engine body, thereby defining a space between an outer surface of the engine body and a surface of the pipe facing toward the outer surface of the engine body, the engine body including a cooling water port on the outer surface of the engine body facing the space, the marine engine further comprising a connector device disposed at least partially in the space and connecting the cooling water port with at least a first cooling water conduit, wherein the fist connector is arranged such that the first cooling water conduit extends generally parallel to the outer surface of the engine body facing the space.

15. A marine engine comprising an engine body, the engine body defining at least one combustion chamber, a cooling jacket in thermal communication with the engine body and configured to allow water to be pumped therethrough so as to cool at least a portion the engine body, at least one port configured to allow a gaseous fluid to pass between an exterior of the engine body and an interior of the combustion chamber, at least one pipe configured to guide at least a gaseous fluid between an exterior of the engine and the at least one port, the at least one pipe extending from the port and outwardly away from the engine body, thereby defining a space between an outer surface of the engine body and a surface of the pipe facing toward the outer surface of the engine body, the engine body including a cooling water port on the outer surface of the engine body facing the space, the marine engine further comprising a connector device disposed at least partially in the space and connecting the cooling water port with at least a first cooling water conduit, and a second cooling water conduit, wherein the connector device comprises at least first and second connectors extending generally transverse to the cooling water port, the first and second connectors being fluidically connected to the first and second cooling water conduits.

16. The marine engine according to claim 15, wherein the first and second connectors extend generally transverse to each other.

17. The marine engine according to claim 15, wherein both of the first and second connectors extend generally parallel to the portion of the outer surface of the engine body facing the space.

18. A marine engine comprising an engine body, the engine body defining at least one combustion chamber, a cooling jacket in thermal communication with the engine body and configured to allow water to be pumped therethrough so as to cool at least a portion the engine body, at least one port configured to allow a gaseous fluid to pass between an exterior of the engine body and an interior of the combustion chamber, at least one pipe configured to guide at least a gaseous fluid between an exterior of the engine and the at least one port, the at least one pipe extending from the port and outwardly away from the engine body, thereby defining a space between an outer surface of the engine body and a surface of the pipe facing toward the outer surface of the engine body, the engine body including a cooling water port on the outer surface of the engine body facing the space, the marine engine further comprising means for connecting the cooling water port with at least a first cooling water conduit, wherein at least one of the means for connecting and the first cooling conduit is disposed at least partially in the space.

19. The marine engine according to claim 18, wherein the at least one port is an exhaust port.

20. The marine engine according to claim 19, in combination with a boat.

* * * * *

UNITED STATES PATENT AND TRADEMARK OFFICE

CERTIFICATE OF CORRECTION

PATENT NO. : 7,455,035 B2
APPLICATION NO. : 11/519478
DATED : November 25, 2008
INVENTOR(S) : Daisuke Sanai It is certified that error appears in the above-identified patent and that said Letters Patent is hereby corrected as shown below:

At column 2, line 22, after "portion" insert --of--.

At column 2, line 41, after "portion" insert --of--.

At column 5, line 46, change "26." to --20.--.

At column 8, line 2, change "Which" to --which--.

At column 9, line 30 (Approx.), In Claim 9, after "portion" insert --of--.

At column 9, line 53, In Claim 12, after "portion" insert --of--.

At column 10, line 5, In Claim 13, after "portion" insert --of--.

At column 10, line 25, In Claim 14, after "portion" insert --of--.

At column 10, line 39, In Claim 14, change "fist" to --first--.

At column 10, line 46, In Claim 15, after "portion" insert --of--.

At column 11, line 9 (Approx.), In Claim 18, after "portion" insert --of--.

Signed and Sealed this

Thirtieth Day of March, 2010

David J. Kappos

David J. Kappos
*Director of the United States Patent and Trademark Office*